US005360094A

United States Patent [19]

Adams et al.

[11] Patent Number: 5,360,094

[45] Date of Patent: Nov. 1, 1994

[54] COLLECTION, STORAGE AND DISPENSING SYSTEM FOR SHOPPING CARTS

[75] Inventors: John Adams, Holmes Beach, Fla.; Mel Decker, 5441 Vanderpipe Rd., Sarasota, Fla. 34241

[73] Assignee: Mel Decker, Sarasota, Fla.

[21] Appl. No.: 185,685

[22] Filed: Jan. 24, 1994

[51] Int. Cl.[5] ..... G07F 7/00

[52] U.S. Cl. ..... 194/212; 186/60; 186/62; 194/905

[58] Field of Search ..... 194/905, 212; 198/321; 186/27, 52, 58, 60, 62

[56] References Cited

U.S. PATENT DOCUMENTS

| | | | |
|---|---|---|---|
| 1,292,938 | 1/1919 | Wegener | 198/321 |
| 2,791,291 | 5/1957 | Grondona | 186/60 |
| 3,561,567 | 2/1971 | Bradley . | |
| 3,655,013 | 4/1970 | Weller | 186/58 |
| 4,518,072 | 5/1985 | Muellner et al. | 194/205 X |
| 4,518,073 | 5/1985 | Pastien | 186/27 X |

*Primary Examiner*—F. J. Bartuska
*Attorney, Agent, or Firm*—Charles J. Prescott

[57] ABSTRACT

A collection, storage and dispensing system for shopping carts including an elongated tubular conduit sized to allow a shopping cart to rollably pass therethrough. The conduit includes a sloped first end section defining an entrance opening through which shopping carts enter the system, a generally horizontal mid section, and a sloping second end section which defines an exit opening through which shopping carts exit the system. The mid section is preferably buried below grade, but may also be elevated above a parking lot surface of a store for vehicles to drive beneath, A floor is provided within the conduit atop which shopping carts roll. An elongated slender guide engaging probe is connected to each shopping cart which both laterally guides the carts by slidably engagement into a guide channel longitudinally in the floor and is pullably engaged onto a chain-type conveyor in one end section which is upwardly sloped. The entrance opening is positioned at grade level of a store parking area while the exit opening is positioned within the store at floor level. A denester interactive with each of the probes is provided as the carts tend to wedge together. Multiple entrance openings are provided, along with an optical comparator to insure that only proper shopping carts enter the system.

11 Claims, 6 Drawing Sheets

COLLECTION, STORAGE AND DISPENSING SYSTEM FOR SHOPPING CARTS

BACKGROUND OF THE INVENTION

1. SCOPE OF INVENTION

This invention relates generally to shopping carts which are used at supermarkets, department stores and the like, and more particularly to a system for collecting shopping carts from a parking area, storing those shopping carts and dispensing them back into the store for use.

2. PRIOR ART

Utilization of a shopping cart at grocery and department store centers has become commonplace. Shoppers may each use such a cart while proceeding through the store to gather items for purchase and checkout. After checkout, the purchased items are typically carried in the shopping cart to the customer's vehicle. After unloading the shopping cart, the customers will typically simply push the shopping cart aside and leave it outside in the parking area of the store. Periodically, employees must then retrieve the shopping carts scattered over a broad area of the parking lot and return them into the store. While unattended, these carts are subject to theft, collision damage with vehicles, vandalism and weather deterioration.

Applicants are unaware of any system which automatically attends to this gathering or retrieval, storing and dispensing of shopping carts without employee involvement.

A number of prior art devices are directed to some aspect of shopping cart storage and/or handling. In the patent invented by Bradley, U.S. Pat. No. 3,561,567, a storage and dispensing system for shopping carts is disclosed which utilizes compartments within an elongated display case for storing the carts.

In U.S. Pat. No. 3,655,013, Weller teaches floor-to-floor conveying means for movement of shopping carts between floors of a department store. Two tracks of different gauge width are provided to accommodate and guide both front and rear wheels of differing wheel base of the cart.

An apparatus for encouraging the restitution of a shopping cart such as in a reception area otherwise controlled by wickets is disclosed in U.S. Pat. No. 4,428,893 invented by Gillet. This patent discloses an apparatus having vertically hinged doors and dispenses a ticket or token when a proper cart is moved therethrough. This apparatus also identifies unacceptable shopping carts which are dissimilar to those for which the apparatus is designed, Muellner teaches a cart conveyor and dispensing apparatus in U.S. Pat. No. 4,518,072, This invention is directed to an enclosed conveyor for propelling a shopping cart therethrough. Shopping carts are propelled by engagement of their wheels by a continuous member that carries a cross bump or upwardly extending protrusion.

The present invention provides a shopping cart retrieval system which, without interfering with traffic flow, will facilitate retrieval of shopping carts from the parking area, store those shopping carts in either nested or unnested configuration and then dispense shopping carts into the store as required or desired.

BRIEF SUMMARY OF THE INVENTION

This invention is directed to a collection, storage and dispensing system for shopping carts including an elongated tubular conduit sized to allow a shopping cart to rollably pass therethrough. The conduit includes a sloped first end section defining an entrance opening at one end through which shopping carts enter the system, a generally horizontal mid section and a sloping second end section which defines an exit opening through which shopping carts exit the system. The mid section is preferably buried below grade, but may also be elevated above a parking lot surface of a store for vehicles to drive beneath. A floor is provided within the conduit atop which shopping carts roll. An elongated slender guide or probe is connected to each shopping cart which both laterally guides the carts by slidably engagement into a guide channel longitudinally in the floor and is pullably engaged onto a chain-type conveyor in one end section which is upwardly sloped. The entrance opening is positioned at grade level of a store parking area while the exit opening is positioned within the store at floor level. A denester is provided as the carts tend to wedge together. Multiple entrance openings are provided, along with an optical comparator to insure that only proper shopping carts enter the system.

It is therefore an object of this invention to provide a system for collecting from a parking area, storing and dispensing shopping carts into a store.

It is yet another object of this invention to provide a system for retrieving shopping carts from a parking area of a store, storing those shopping carts and dispensing them into the store without interfering with traffic flow in the parking area.

It is yet another object of this invention to provide a shopping cart retrieval storage and dispensing system which encourages shoppers to return their shopping carts to a remote shopping cart entrance opening located in the parking area without inconveniencing the shopper.

It is yet another object of this invention to provide a retrieval, storage and dispensing system for shopping carts which identifies and rejects shopping carts which are dissimilar to a standard, proper shopping cart for the system.

It is yet another object of this invention to provide a retrieval, storage and dispensing system for shopping carts which will store shopping carts in either a nested or unnested configuration and then automatically denest and dispense those shopping carts into the store as desired.

In accordance with these and other objects which will become apparent hereinafter, the instant invention will now be described with reference to the accompanying drawings.

DETAILED DESCRIPTION OF THE INVENTION

Figure 1:
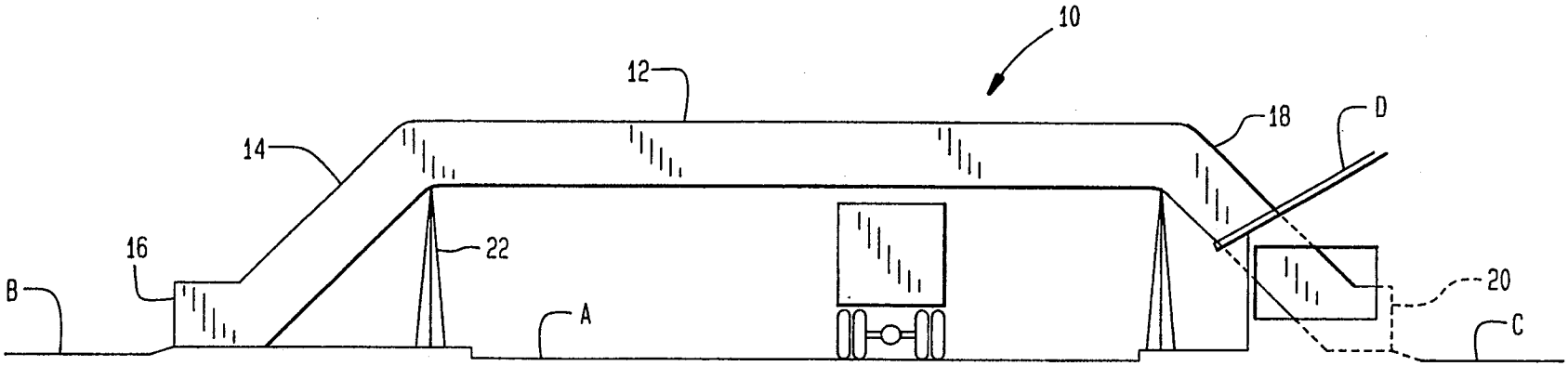
FIG. 1 is a side elevation schematic view of an overhead embodiment of the invention.
Figure 2:
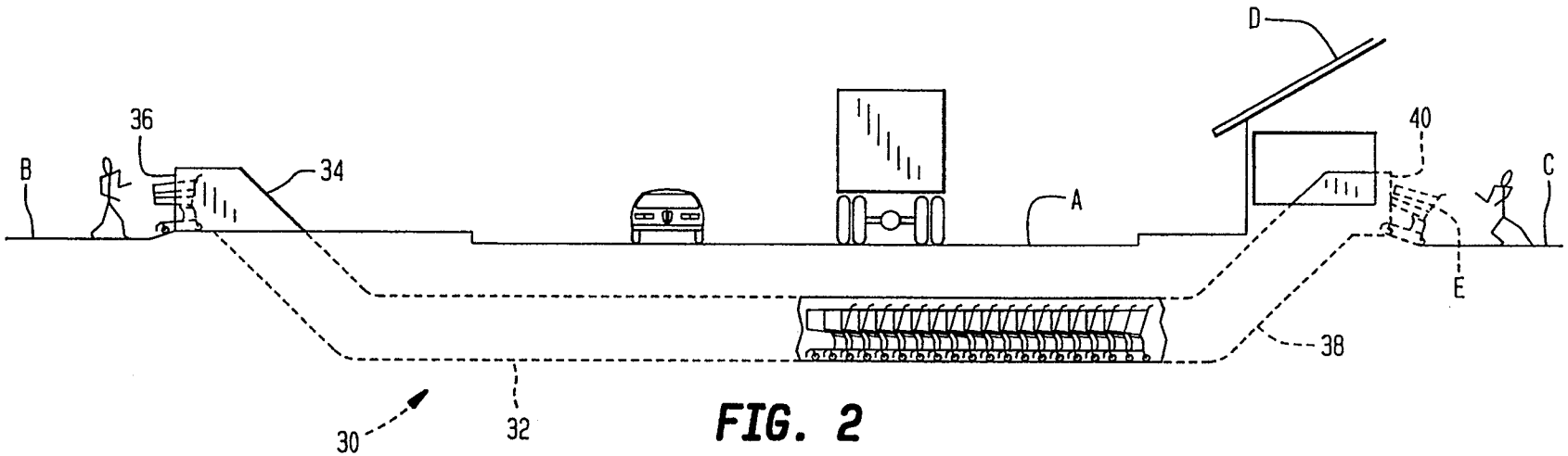
FIG. 2 is a side elevation schematic view of a below grade level embodiment of the invention.

Referring now to the drawings, and particularly to FIGS. 1 and 2, one embodiment of the invention is shown generally at numeral 10, that being an overhead embodiment of the invention where the central or mid section 12 of an elongated tubular conduit is positioned and held above a driving surface A of a parking lot by supports 22. This embodiment 10 includes an upwardly sloped or inclined tubular end section 14 defining an entrance opening 16 positioned at parking grade level B and a downwardly sloped or inclined tubular end section 18 which defines an exit opening 20 which is positioned within a store D at floor surface level C. Mid section 12 is preferably slightly inclined downward from left to right at an angle of about one to two degrees to allow gravity to assist in moving and gently nesting shopping carts E therein.

In FIG. 2, another embodiment of the invention is shown generally at numeral 30, having a mid section 32 which is positioned below grade level A. This embodiment 30, again includes a tubular mid section 32 which is buried beneath the parking lot drive surface A, extended at one end by upwardly sloping end section 34 to define an entrance opening 36 positioned at parking grade level El and extended at the opposite end by tubular end section 38 to define an exit opening 40 within store D positioned at floor level C.

Figure 3:
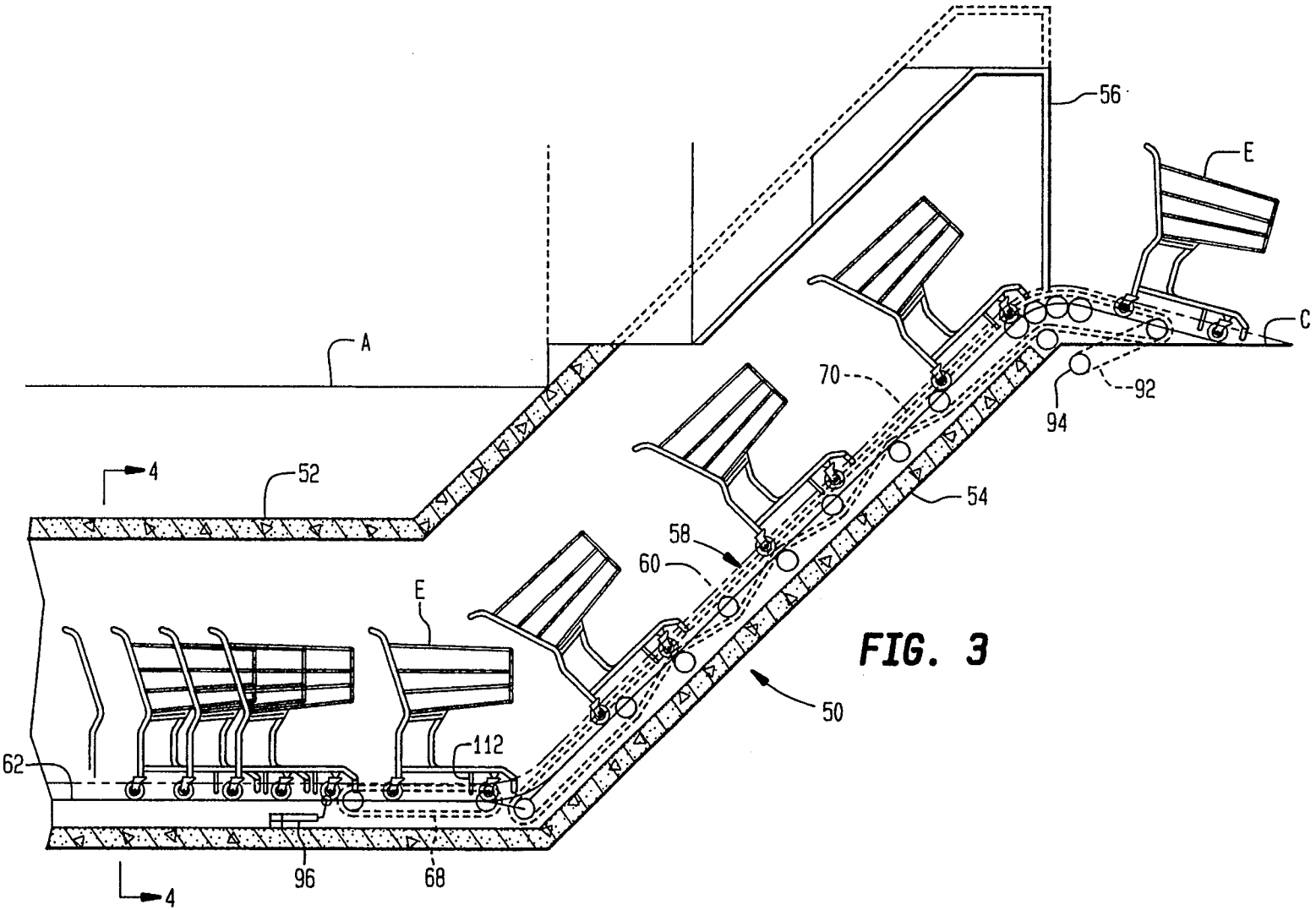
FIG. 3 is a side elevation section view of a portion of the preferred below grade embodiment of the invention.
Figure 4:
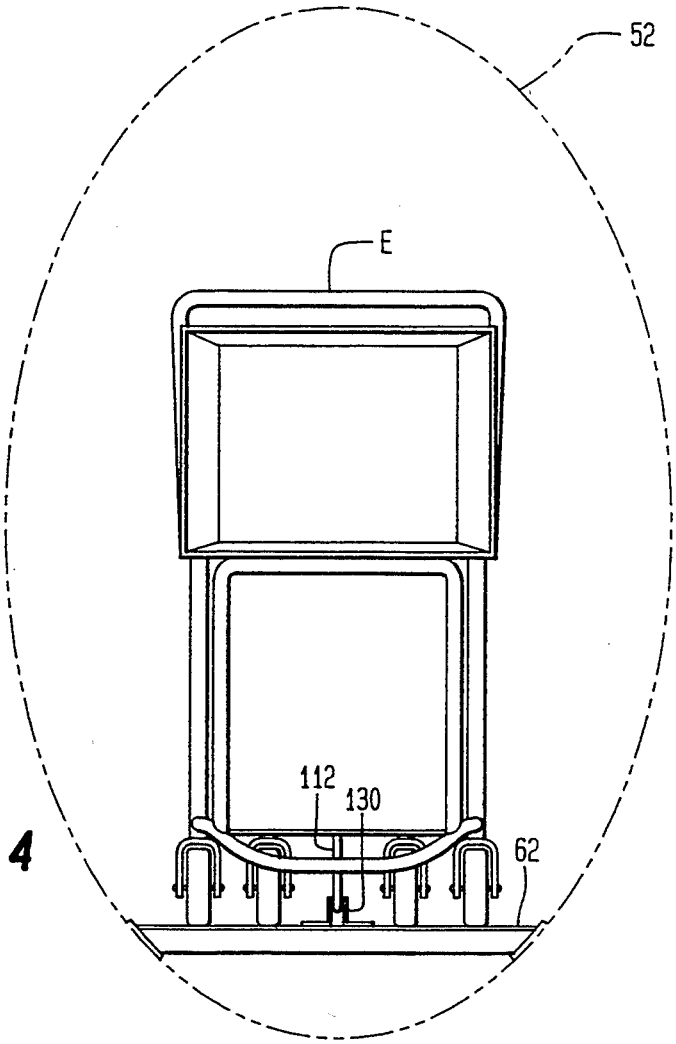
FIG. 4 is a section view in the direction of arrows 4—4 of FIG. 3.
Figure 5:
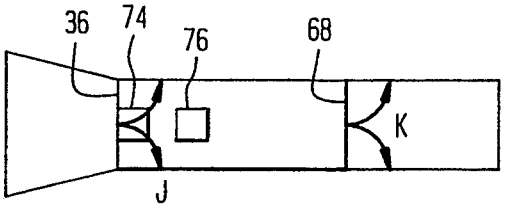
FIG. 5 is a top plan schematic view of one end of the invention shown in FIG. 3 showing the entrance thereof.
Figure 7:
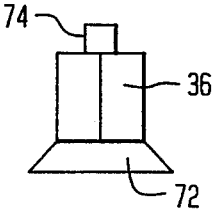
FIG. 7 is a left end elevation view of FIG. 6.
Figure 6:
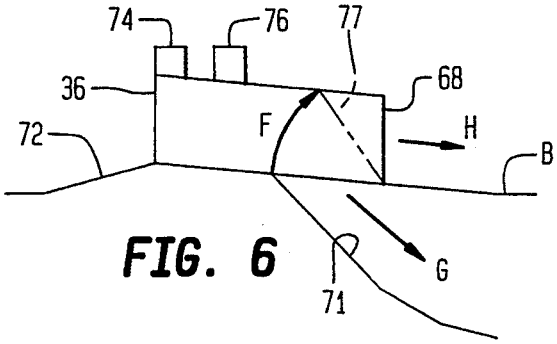
FIG. 6 is a side elevation view of FIG. 5.
Figure 8:
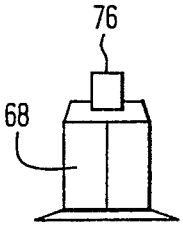
FIG. 8 is a right end elevation view of FIG. 6.

Referring additionally to FIGS. 3 and 4, the preferred tubular conduit structure for a below grade embodiment is in the form of precast reinforced concrete conduit as utilized in highway construction although steel and composite plastic material may also be used. The generally oval or elliptic cross section as shown typically in FIG. 4 in phantom at 52 is further preferred.

Although the embodiment 30 of the invention shown in FIG. 2 envisions rearward orientation of each shopping cart E within the system 30, it is preferred as shown in FIG. 3 that each of the shopping carts E be oriented forwardly. Within each of the end and mid sections of the conduit as typically shown at 52 and 54 in FIG. 4, a floor structure 62 (typ.) is provided to support each shopping cart E. This floor 62 extends horizontally transversely across the lower cross section of the conduit section 52 and 54 so that each shopping cart E remains upright with respect to lateral orientation. The floor 62 (typ.) also includes two spaced apart channel members 130 which define a longitudinal guide slot therebetween into and along which a downwardly extending probe 112 connected to a lower area of each shopping cart E engages so as to maintain each of the shopping carts E in a laterally central position atop floor 62 (typ.).

In the generally preferred embodiment wherein the mid sections 32 and 52 of the conduit are buried beneath the parking lot surface A, once each shopping cart E is pushed through the entrance opening 36 in FIG. 2 (not shown in FIG. 3), gravity acts to move each shopping cart E downwardly through sloped end conduit section 34 in FIG. 2 (not shown in FIG. 3) and then along the mid section 32 or 52 until becoming nested with the next forwardly positioned shopping cart as shown in FIGS. 2 and 3. To further enhance the action of gravity to accomplish this nesting of shopping carts for storage, each of the mid sections 32 and 52 are very gently sloped downwardly at a preferred slope of about one to two degrees toward the corresponding end section 38 and 54, respectively.

Referring now to FIGS. 5 to 8, the details of the preferred embodiment of the entrance opening 36 and associated downwardly sloping conduit structure is there shown. A pair of swinging doors are pivotally connected at their outer opposing margins so that a shopping cart E may be pushed up lead-in ramp 72 into these doors for opening in the direction of arrows J in FIG. 5. An optical comparator 76 is provided for scanning the shopping cart which has been so introduced through entrance 36. If the shopping cart differs from a standard image or includes articles remaining therein such as a purse or groceries, the optical comparator 76 provides a reject signal which prevents trap door 77 from opening in the direction of arrow F. In such event, the cart will then discharge by gravity in the direction of arrow H because of the sloped surface out from hinged doors 68 which open in the direction of arrow K.

If the optical comparator 76 properly identifies an acceptable shopping cart E, trap door 77 then opens in the direction of arrow F so that the shopping cart E will be carried downwardly by gravity on surface 71 in the direction of arrow G into the system. Simultaneously with opening of the trap door 77, a token dispenser 74 dispenses a single token which the shopper may then redeem in the store D on a subsequent shopping visit.

Figures 9, 10, 11, 12:
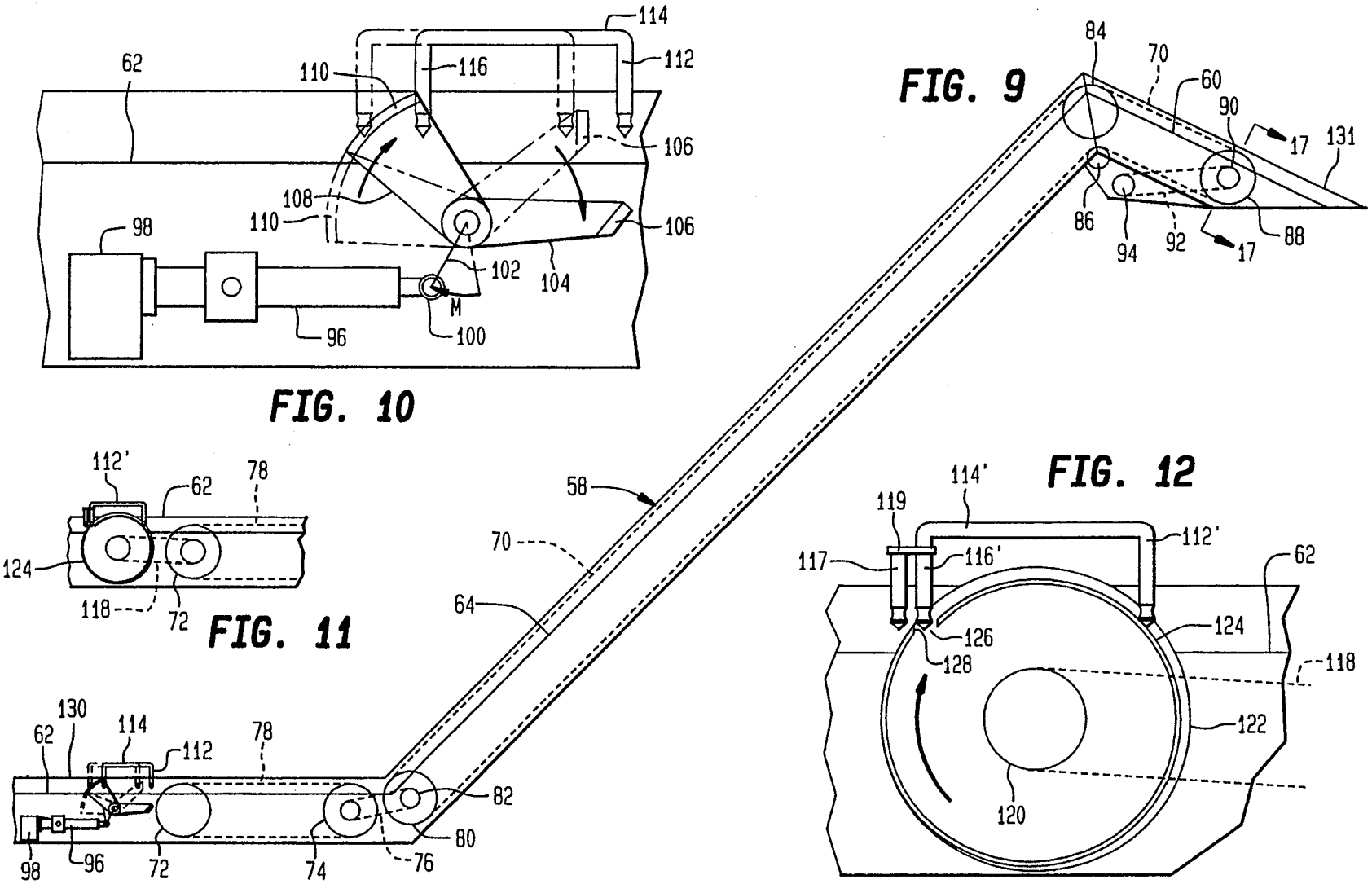
FIG. 9 is a schematic side elevation view of the guide and conveyor mechanism of FIG. 3.
FIG. 10 is an enlarged view of one embodiment of a shopping cart denester shown in FIG. 9.
FIG. 11 is a partial view of another embodiment of a shopping cart denester.
FIG. 12 is an enlarged view of FIG. 11.
Figure 15:
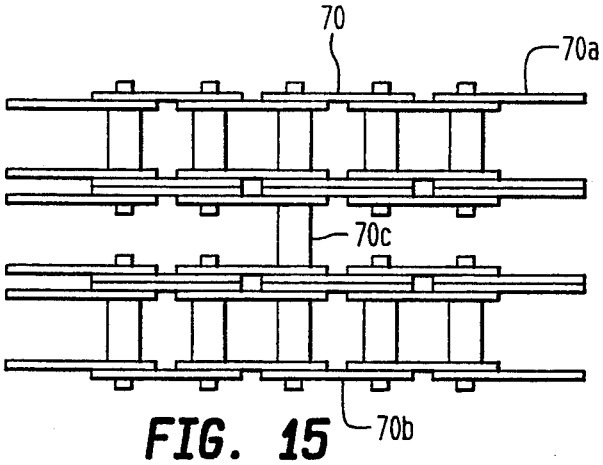
FIG. 15 is a top plan view of a portion of a conveyor chain of FIG. 9.
Figure 17:
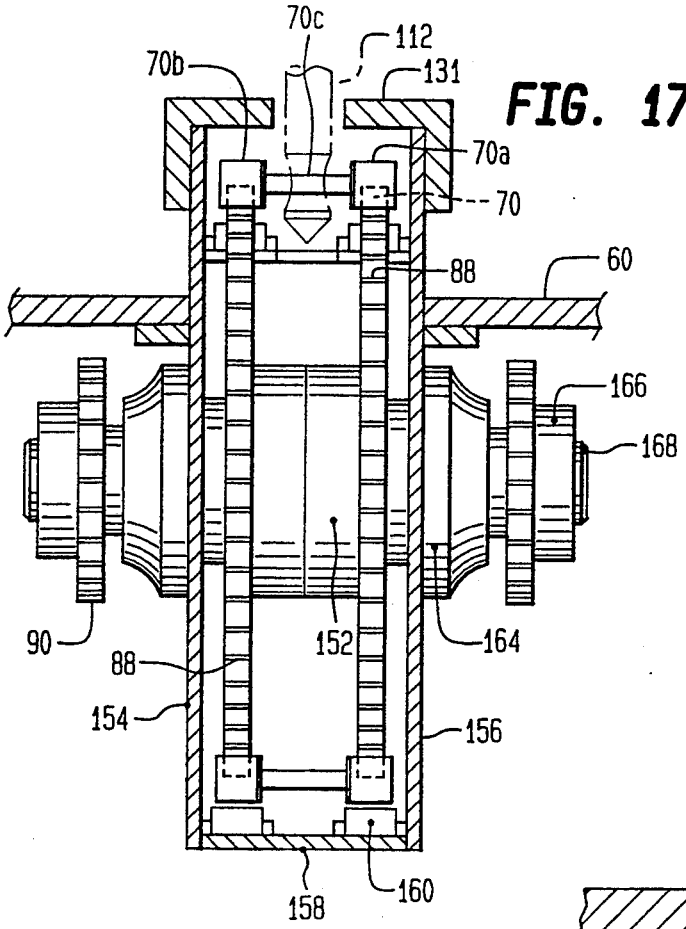
FIG. 17 is a section view in the direction of arrows 17–17 in FIG. 9.
Figure 19:
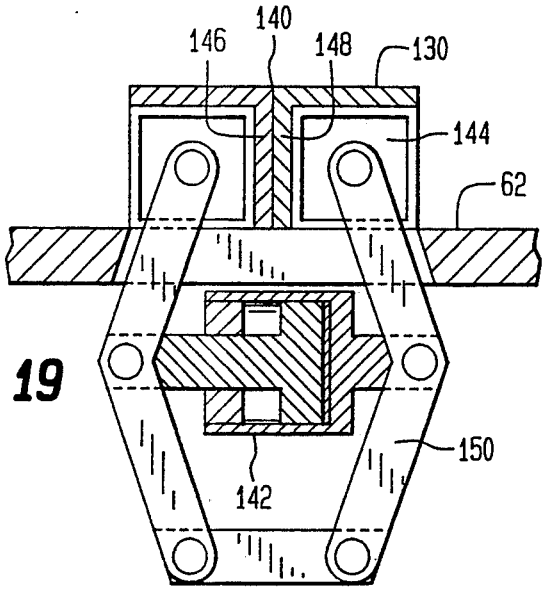
FIG. 19 is a section view in the direction of arrows 19–19 in FIG. 16*b*.

A means for upwardly conveyance of each of the shopping carts E toward the exit opening 40 is shown generally at numeral 58 in FIG. 3 and in greater detail in FIG. 9. This shopping cart conveyance 58 includes an endless or continuous double row chain 70 as best seen in FIG. 15. This chain 70 is drivably engaged as best seen in FIG. 17 over toothed gears 88 of double sprockets 152 so that each of its rows of links 70*a* and 70*b* are drivably engaged. Periodically spaced cross drive pins 70*c* in FIG. 15 are provided to drivably engage against probe 112 as previously described. A single drive motor 94 acting through drive chain 92 on toothed gears 90 of sprockets 166 on shaft 168 supported by bearings 164 serve to drive this entire chain conveyor arrangement 58. Thus, probe 112, slidably positioned between L-brackets 131 connected to side plates 154 and 156 in Figure 17 provide the centering of each shopping cart E along this upward sloping conveyor 58 and, by engagement of cross drive pin 70*c* against probe 112, upward propulsion of each shopping cart E is accomplished. A slight downturn in the direction of drive chain 70 at exit opening 56 is accomplished by roller gears 64 and 86. Chain 70 is slidably supported on TEFLON chain carriers 160 on bottom plate 158.

As best seen in FIGS. 3 and 9, a short drive chain 78, similar in construction to that shown in FIG. 15, being driven by sprocket 74, which in turn is driven by chain 76, sprocket 82/80 and then chain 70, acts in combination to denest or separate each of the shopping carts E before entering into engagement with the conveyor 58 as will be described herebelow.

In FIG. 10, the details of one embodiment of the denester as shown in FIG. 9 are now described. Actuator 96 mounted on block 98, moves its end pivot connection 100 in the direction of arrow M for each denesting cycle. This movement, in turn, pivots link 102 which is connected with arm plates 104 and 108 pivoting them in the direction of the arrows. Flange 106, previously engaged against probe 112 (in phantom) thus moves out of the way. Flange 110 then rotates upwardly so as to block movement of the next rearward probe 112 (not shown). Simultaneously, the leading edge of flange 110 contacts against probe 116 so as to urge the cross member 114, from which these two downwardly extending probes 112 and 116 depend and shopping cart E to which it is connected, forwardly for engagement with chain 78.

An alternate embodiment of a denesting arrangement is shown in FIGS. 11 and 12 which incorporates a dual probe arrangement 112'/116'/117 and a rotating denesting drum 124 mounted on plate 122 driven on sprocket 120 by chain drive 122. A single slot 126 is formed into cylindrical drum 124 so that, as it rotates in the direction of the arrow, driven by chain 118, slot 126, being outwardly formed at 128 engages in between dual probes 116' and 117, connected by bracket 119. As the cylindrical drum 124 rotates in this fashion, the next rearward probe 112' (not shown) is prevented from movement by contact against the smooth surface of drum 124 so that the associated forward cart to which member 114' is connected is driven forwardly and denested from the next rearward shopping cart E. Note importantly that both of these denester arrangements are reversible.

Figure 18:
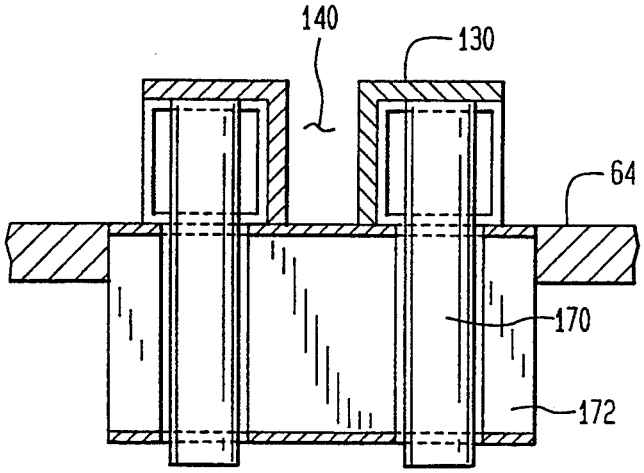
FIG. 18 is a section view in the direction of arrows 18–18 in FIG. 16*a*.

As best seen in FIGS. 16*a*, 16*b*, 18 and 19, a braking arrangement is provided within mid section 52 of FIG. 3. This breaking arrangement is in the form of closable guide rails 130 so that the slot 140 is variable in width by hydraulic actuator 142 which acts upon pivoted links 150 to urge blocks 144 together along with upright faces 146 and 148. This closing action provides frictional engagement against probe 112. In FIG. 18, guide channels 130 are fixed in position by members 170 within 172 rigidly connected to floor section 64 so that gap 140 is maintained at a width slightly greater than the diameter of probe 112.

Figure 13:
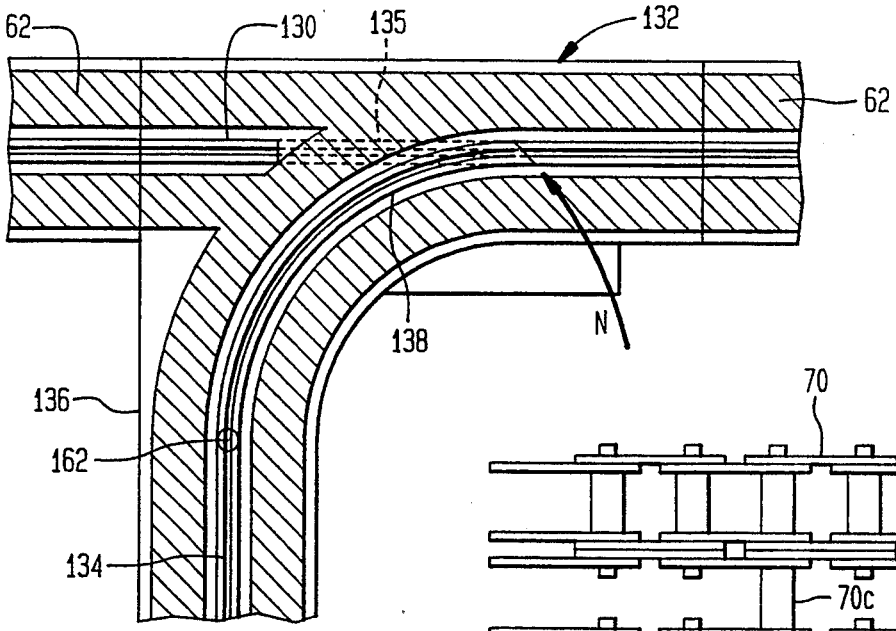
FIG. 13 is a top plan view of a shopping cart guide switch which accommodates both main and branch shopping cart conduits, the switch being in a position to accept shopping carts from the branch conduit.
Figure 14:
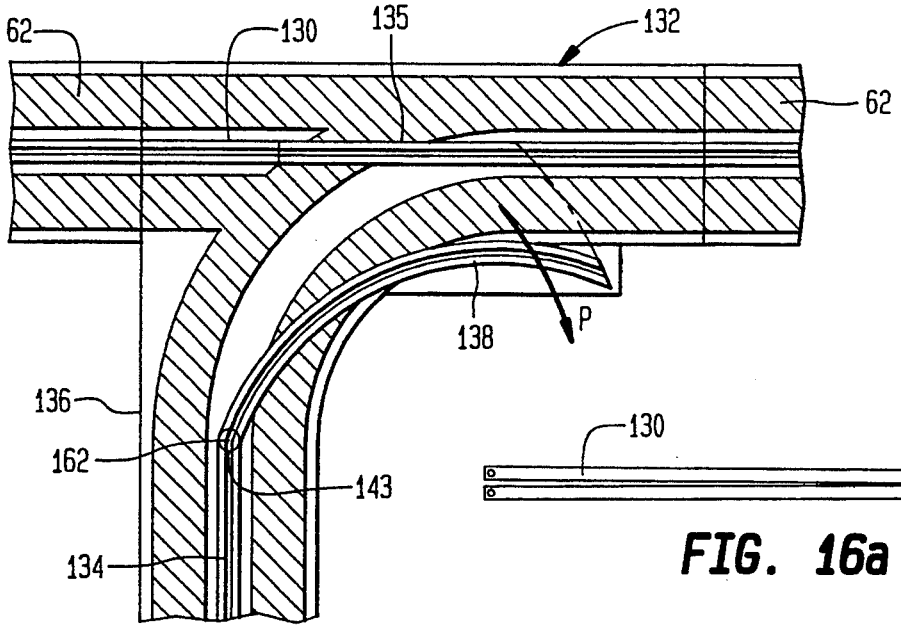
FIG. 14 is a view similar to FIG. 13 wherein the switch is in a position to accept shopping carts from the main conduit.
Figure 16A:
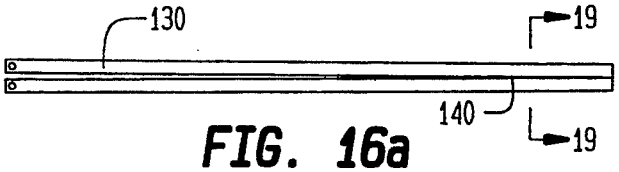
FIG. 16*a* is a top plan view of the shopping cart guide member of FIG. 9 in its open configuration.
Figure 16B:
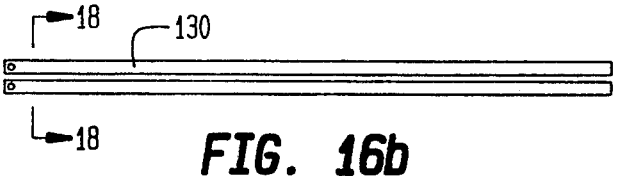
FIG. 16*b* is a view of FIG. 16*a* with one end thereof in a closed or shopping cart braking configuration.

Although a single entrance opening may be provided at a single fixed location within a parking lot area, called a main entrance opening as previously described, branch entrance openings may be provided as well, strategically placed around the parking area. These branch entrances would be similar to that previously described. Within the mid section 52 of the system 50, as best seen in FIGS. 13 and 14, a branch switch is generally shown at 132 and includes a pivotally mounted arcuate channel or guide section 138 on floor 136 for engagement with probe 112 as previously described. This arcuate channel section 138, when pivoted about 162 in the direction of arrow N allows shopping carts to be merged onto the floor 62 of the main mid section 52. As arcuate member 138 is rotated in the direction of arrow N, a section 135 of the guide member 130 is also lowered.

To disengage arcuate member 138, pivoting in the direction of arrow P in FIG. 14 is provided while raising section 135 back to the same height as channel guide member 130. At that time, shopping carts moving within guide member 134 will contact against surface 143 and stopped.

Details of the preferred embodiments 30 and 50 which are below grade are equally applicable to the above-grade embodiment 10 shown in FIG. 1. However, the conveyor 58 described in FIG. 3 is positioned in the upsloping section 14, gravity then carrying the shopping carts through mid section 12 (slightly sloped downwardly) and end section 18. The broken arrangement of FIGS. 16*a* and 16*b* may be required in both mid section 12 and end section 18.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A collection, storage and dispensing system for shopping carts comprising:

an elongated tubular conduit means sized to allow a shopping cart to be rolled in generally upright longitudinal orientation therethrough;

said conduit means having a generally horizontal mid section positioned below a driving surface of a parking area adjacent a store and sloping first and second end sections, said first end section defining a shopping cart main entrance opening positioned at grade level of the parking area at a remote location from the store, the other said end section defining a shopping cart exit opening positioned at floor level within the store;

a floor means sized and positioned within said conduit means for rollably supporting a plurality of shopping carts thereon;

downwardly extending engaging means connected to a lower area of each shopping cart;

guide means centrally positioned along said floor means for receiving and laterally directing each one of said engaging means whereby each shopping cart entering said conduit means is generally centered and guided along said floor means;

conveyor means mounted in said floor engagable with each said engaging means for transporting each shopping cart upwardly along said first end section and along said mid section to be, then assisted by gravity along said second end section for discharge from said exit opening, each cart being assisted by gravity to roll along said first end section and said mid section.

2. A collection, storage and dispensing system as set forth in claim 1, further comprising:

denesting means positioned in said mid section adjacent to said second end section for separating adjacent shopping carts from one another just prior to each shopping cart entering onto said floor means in said second end section.

3. A collection, storage and dispensing system as set forth in claim 2, further comprising:

braking means in a portion of said guide means along said mid section for frictional contact with said engaging means to slow the speed of forward roll of each shopping cart.

4. A collection, storage and dispensing system as set forth in claim 3, further comprising:

an elongated tubular branch conduit means sized to allow a shopping cart to be rolled in generally upright longitudinal orientation therethrough;

said branch conduit means having a generally horizontal branch mid section positioned below grade level and a sloping first end section defining a shopping cart branch entrance opening positioned at grade level of the parking area, one end of said branch mid section connected by a branch switch to said mid section;

branch floor means sized and positioned within said branch conduit means for rollably supporting a plurality of shopping carts thereon;

branch guide means centrally positioned along said additional floor means for receiving and laterally directing each one of said engaging means whereby each shopping cart entering said branch conduit means is generally centered and guided along said branch floor means;

said branch switch being switchable to allow shopping carts to pass therealong from either said main entrance opening or said branch entrance opening.

5. A collection, storage and dispensing system as set forth in claim 4, further comprising:

means for issuing a token for each shopping cart passing into said entrance opening;

said token being redeemable in the store.

6. A collection, storage and dispensing system as set forth in claim 1, wherein:

said conduit means is formed of road drainage conduit having a generally oval cross section and being fabricated of reinforced concrete.

7. A collection, storage and dispensing system as set forth in claim 1, further comprising:

an optical comparator means positioned in said first end section adjacent said entrance opening;

said optical comparator means viewing each shopping cart passing through said entrance opening for comparison to a standard shopping cart image;

a trip door means positioned generally horizontally in said first end section which opens automatically to allow each shopping cart passing through said entrance opening which is optically similar to said standard shopping cart to continue into said mid section;

a reject door means positioned at grade level through which all shopping carts optically dissimilar to said standard shopping cart image will automatically pass back onto grade level when said trip door remains in a closed position.

8. A collection, storage and dispensing system as set forth in claim 4, further comprising:

an elongated tubular branch conduit means sized to allow a shopping cart to be rolled in generally upright longitudinal orientation therethrough;

said branch conduit means having a generally horizontal branch mid section positioned below grade level and a sloping first end section defining a shopping cart branch entrance opening positioned at grade level of the parking area, one end of said branch mid section connected by a branch switch to said mid section;

branch floor means sized and positioned within said branch conduit means for rollably supporting a plurality of shopping carts thereon;

branch guide means centrally positioned along said additional floor means for receiving and laterally directing each one of said engaging means whereby each shopping cart entering said branch conduit means is generally centered and guided along said branch floor means;

said branch switch being switchable to allow shopping carts to pass therethrough from either said main entrance opening or said branch entrance opening.

9. A collection, storage and dispensing system for shopping carts comprising:

an elongated tubular conduit means sized to allow a shopping cart to be rolled in generally upright longitudinal orientation therethrough;

said conduit means having a generally horizontal mid section positioned above grade level a distance sufficient for vehicles to drive thereunder spanning a driving surface adjacent a store, said conduit means also having sloping first and second end sections, said first end section defining a shopping cart entrance opening positioned at the grade level of a parking area remotely located from the store, said second end section defining a shopping cart exit opening positioned at floor level within the store;

a floor means sized and positioned within said conduit means for rollably supporting a plurality of shopping carts thereon;

downwardly extending engaging means connected to a lower area of each shopping cart, guide means centrally positioned along said floor means for receiving and laterally directing each one of said engaging means whereby each shopping cart entering said conduit means is generally centered and guided along said floor means;

conveyor means mounted in said floor engagable with each said engaging means for transporting each shopping cart upwardly along said first end section then to be assisted by gravity to roll along said mid section and said second end section for discharge from said exit opening.

10. A collection, storage and dispensing system as set forth in claim 9, further comprising:

denesting means positioned in said mid section adjacent to said second end section for separating adjacent shopping carts from one another just prior to each shopping cart entering onto said floor means in said second end section.

11. A collection, storage and dispensing system as set forth in claim 9, further comprising:

an optical comparator means positioned in said first end section adjacent said entrance opening;

said optical comparator means viewing each shopping cart passing through said entrance opening for comparison to a standard shopping cart image;

a trip door means positioned generally horizontally in said first end section which opens automatically to allow each shopping cart passing through said entrance opening which is optically similar to said standard shopping cart to continue into said mid section;

a reject door means positioned at grade level through which all shopping carts optically dissimilar to said standard shopping cart image will automatically pass back onto grade level when said trip door remains in a closed position.

* * * * *